United States Patent [19]

Reining

[11] Patent Number: 4,557,311

[45] Date of Patent: Dec. 10, 1985

[54] PROTECTIVE COVERING

[76] Inventor: Kuno Reining, In der Stelle 15, 7765 Bodman, Fed. Rep. of Germany

[21] Appl. No.: 487,440

[22] Filed: Apr. 21, 1983

[30] Foreign Application Priority Data

Apr. 21, 1982 [DE] Fed. Rep. of Germany ..... 3214801

[51] Int. Cl.[4] ..... A47H 23/01

[52] U.S. Cl. ..... 160/330

[58] Field of Search ..... 160/368 R, 368 S, 368, 160/330, 84 R

[56] References Cited

U.S. PATENT DOCUMENTS

| | | | |
|---|---|---|---|
| 677,201 | 6/1901 | Geiger | 160/330 X |
| 1,110,857 | 9/1914 | Applas | 160/330 |
| 1,619,280 | 3/1927 | Wheeler | 160/19 |
| 1,691,339 | 11/1928 | Deming | 160/330 |
| 1,736,885 | 11/1929 | Morrill | 160/330 UX |
| 2,299,173 | 10/1942 | Pidgeon | 160/84 R |
| 3,321,003 | 5/1967 | Boerner | 160/330 X |
| 3,616,838 | 11/1971 | Barr | 160/368 R |
| 4,346,875 | 8/1982 | Spencer | 160/368 R |

FOREIGN PATENT DOCUMENTS

| | | | |
|---|---|---|---|
| 998785 | 1/1952 | France | 160/368 R |
| 530378 | 8/1958 | Italy | 160/330 |

*Primary Examiner*—Ramon S. Britts
*Assistant Examiner*—Cherney S. Lieberman
*Attorney, Agent, or Firm*—Karl W. Flocks; Sheridan Neimark; A. Fred Starobin

[57] ABSTRACT

A shade serving to shelter from light, wind, and vision is useful especially at balconies of buildings. The shade comprises a web made of foldable, weatherproof material and adapted to be stretched over an opening to be shielded in a wall or between walls of the building. The upper part of the shade is guided by means of sliding hooks or rollers provided with hooks along a drapery rod fixed to the wall, while the lower part of the shade is adapted to be secured by push button fasteners to a lower wall member, either in fully or partly stretched condition. When not in use, the shade may be wrapped in a cover which fastened in an area of the wall adjacent the opening.

5 Claims, 7 Drawing Figures

FIG. 5
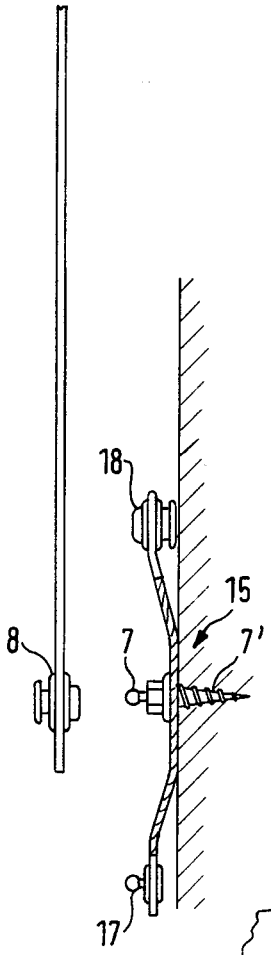
FIG. 6
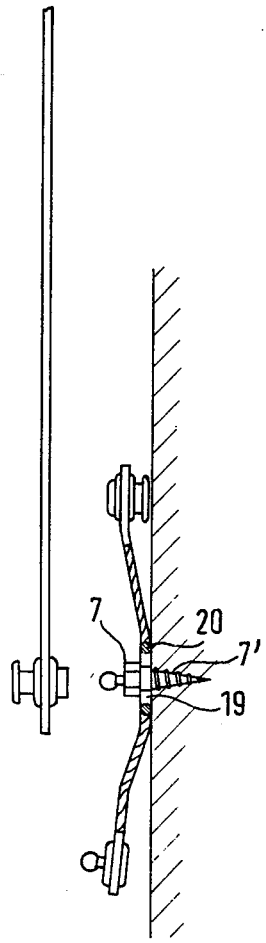
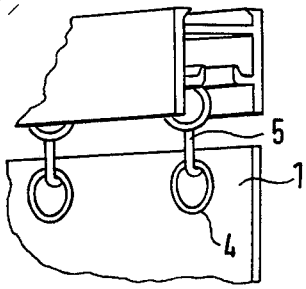
FIG. 7

PROTECTIVE COVERING

The invention relates to a protective covering or shade to shelter from the light, wind and view, particularly at balconies of buildings.

Awnings to be unfolded for sun protection at buildings are quite well known. Usually such awnings are adapted to be stretched out above a space which is to be shielded. Especially with buildings having balconies it is desirable to have also lateral and frontal protection against light, wind, and vision. Conventional awnings do not afford such protection at all or under certain conditions only.

It is an object of the invention to provide a shade which is effective laterally or frontally against the effects of light and wind or vision and easy to be mounted and removed.

To meet the object, a shade of the kind in question is characterized by a web made of foldable, weatherproof material and adapted to be stretched over an opening to be shielded in a wall or between walls, the web being fastened by upper and lower releasable fastening means to an upper member fixed to a wall and to a lower member fixed to a wall.

The shade according to the invention is extremely easy to mount and, upon being attached, covers the opening effectively. The use of lateral shades in accordance with the invention is convenient, for instance, if several balconies belonging to different apartments are located next to one another at a building and are to be shielded particularly against vision from the side. Shielding toward the front by the shade according to the invention, on the other hand, makes sense if buildings having openings to be looked into, e.g. balconies are located face to face.

In a simple embodiment of the shade according to the invention the upper member fixed to the wall conveniently is a drapery rod and the upper fastening means are sliding hooks or rollers provided with hooks which engage in holes formed in the web. The web thus may be moved like drapes along the drapery rod from a position of non-use into the shielding position. As it is movable infinitely along the rod, it may be positioned to shield only partly as well. This is made possible by the drapery rod of which the most varied forms are readily available together with the corresponding sliding elements in the form of hooks or rollers which likewise are of conventional structure. It is advantageous to have the drapery rod made of weatherproof material.

The lower member fixed to the wall preferably is part of the wall itself, and the lower fastening means comprise a plurality of plug-in connections adapted to be locked. These also may be of known structure which is available readily and handled easily, being embodied, for example, by known push button fasteners or rotary tie locks.

Advantageously, a cover for wrapping the web is fixed in a wall area adjacent the opening so as to have a ready means of storing the shade in a position ready for use when it is not being used. This fastening may be releasable so that the cover may be taken off, for instance, when the shade is stretched out. In accordance with a particularly convenient embodiment, the drapery rod is extended beyond the area of the cover and the web is suspended from the drapery rod by means of the sliding hooks or rollers provided with hooks even when it is wrapped up. The lower fastening means, on the other hand, such as push button fasteners or rotary tie locks are released.

The web and the cover advantageously are made of a fabric which is resistant against wear out.

The invention will be described further, by way of example, with reference to the accompanying drawings, in which:

FIGS. 5 and 6 are vertical enlarged partial views of two alternatives of fastening the web and the cover at the wall, the cover being unreleasably fixed (FIG. 5) or releasably (FIG. 6); and FIG. 7 is a perspective view showing the profile of a preferably used drapery rod and the suspension of the web from the same.

Figure 1:
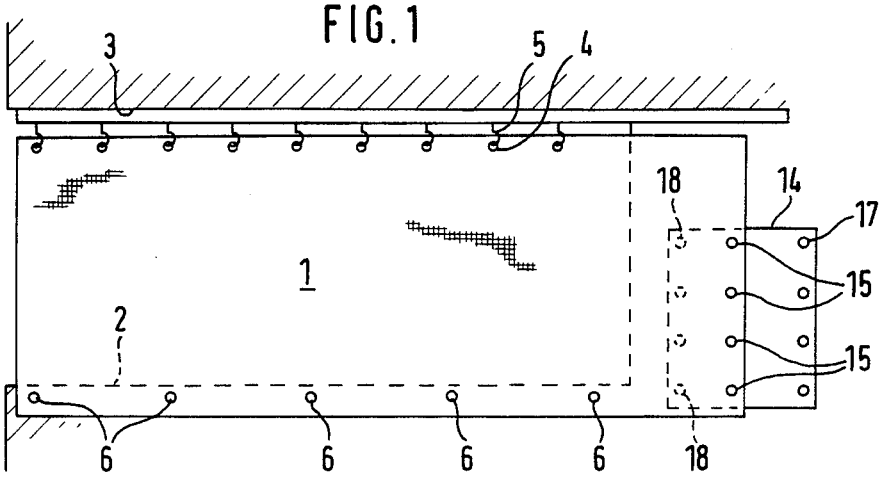
FIG. 1 shows shade according to the invention in stretched condition to cover the opening between two balconies located above each other.

FIG. 1 shows a rectangular web 1 of weatherproof fabric as it is stretched over an opening between a lateral balcony railing 2 of a lower balcony and a balcony bottom 3 of an upper balcony. A drapery rod having the profile as shown in FIG. 7 and being made of metal is secured to the balcony bottom 3. Holes 4 are provided along the upper edge of the web 1 to be engaged by sliding hooks 5 which are movable along the drapery rod in customary manner.

Fastening means 6 for releasably attaching the lower edge of the web 1 to the balcony railing are provided along said railing 2 at horizontal spacings.

Figure 3:
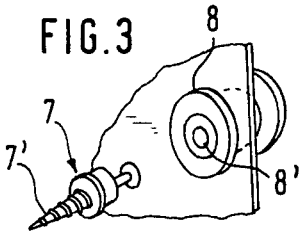
FIGS. 3 and 4 are exploded views of a push button fastener and rotary tie lock, each in released state.
Figure 4:
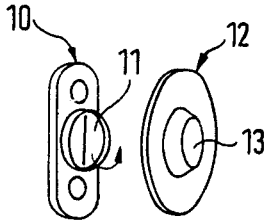

Examples of the fastening means 6 are shown in FIGS. 3 and 4.

A patent fastener type of connection is provided with the embodiment shown in FIG. 3. The plug member 7 of this connector is anchored firmly at the balcony railing 2 by means of a screw 7', while the head 8 including the plug-in hole 8' is secured to the web. Conveniently the push button fastener is of a type which includes a plug member to be pulled against spring force in releasing direction.

FIG. 4 shows a rotary tie lock the plug member 10 of which is secured to the balcony railing 2 by means of two screws (not shown) and includes a rotary tie 11. The rotary tie 11 fits through a hole 13 in a counter-member 12 and is adapted to be locked behind the same by being rotated. When this closure means is used, the counter-member 12 is fixed to the web 1.

Figure 2:
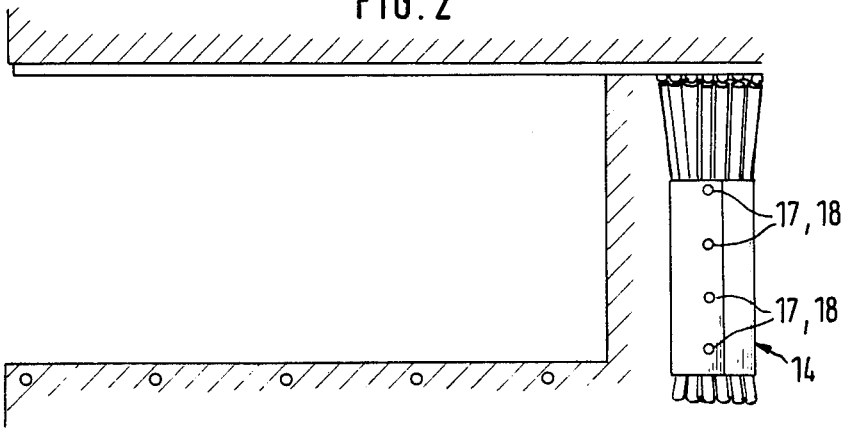
FIG. 2 shows the shade wrapped up in a position of non-use or readiness.

FIGS. 1 and 2 additionally illustrate a cover 14 which can be wrapped around the web 1 when it is not in use, as shown in FIG. 2. The cover 14 is secured to the wall by fastening means 15 which conveniently are of identical design as the fastening means 6, e.g. being push button fasteners in accordance with FIG. 3. This embodiment is shown in FIGS. 5 and 6. The fastening means 15 at the same time serve to fix the web 1 at an area of the wall adjacent the space to be shielded. The cover may be closed around the folded web 1, as shown in FIG. 2, by means of additional push button fasteners with plug member 17 and head 18 preferably of the same kind as the fasteners with plug member 7 and head 8 as shown in FIG. 3.

The embodiment shown in FIG. 6 differs from the one according to FIG. 5 with which the plug member 7 holds the cover 14 firmly at the wall, only in that the cover of FIG. 6 has for each plug member 7 an opening 19 each of enlarged diameter, the opening being trimmed by a metal ring 20. In this manner the cover simply can be hooked to the corresponding plug member 7 and is thus removable when the web 1 is stretched out.

It is obvious that the web 1 affords the lateral and frontal protection against undesired vision or the undesired effects of light and wind, particularly at a balcony.

Of course, other applications of the shade are conceivable as well, e.g. for covering and opening in the wall of vehicle and the like.

What is claimed is:

1. Protective covering to shelter from light, wind, and view, particularly at balconies of buildings, which covering is adapted to be stretched over an opening to be shielded, which opening is in a wall or between walls, comprising upper, lower, and side walls, a web made of foldable, weatherproof material and located so as to be stretched over the opening to be shielded in said walls, an upper member fixed to an upper wall and lower fasteners fixed to said lower wall, said web connected to said upper member, and releasably connected to said lower wall when said web is in stretched condition, a cover for wrapping said web, when said web is not being used by being stretched over the opening to be shielded, said cover being secured at a section of said side wall beyond the opening, said web fastened releasably in stretched condition and stretched at least partially over the area of said cover on said side wall and over the opening to be shielded, said upper member fixed to said top wall being a drapery rod which is extended beyond the opening over the position of said cover, upper fastening means engaged with said web to slidingly connect said web to said drapery rod, lower fastening means to connect said web to said lower wall fasteners, said upper fastening means being sliding hooks engaging in holes formed in said web, other fastening means to hold said cover to said side wall and also to releasably fasten said web to said side wall when said web is in a stretched condition, said web, when in unstretched and folded condition, being suspended from drapery rod by said upper fastening means while said lower fastening means are set free from connection with said lower wall, said cover wrapping said web in said unstretched condition.

2. The protective covering as claimed in claim 1, further characterized by said lower fasteners fixed to said lower wall being part of said lower wall itself, and said lower fastening means connecting said web to said lower wall fasteners comprising a plurality of lockable plug connectors.

3. The protective covering as claimed in claim 2, further characterized by said lockable plug connectors being push button fasteners.

4. The protective covering as claimed in claim 2, further characterized by said lockable plug connectors being rotary tie locks.

5. The protective covering as claimed in claim 1, further characterized in that said cover is fastened releasably at the wall.

* * * * *